US007781660B2

(12) United States Patent
Paterson

(10) Patent No.: US 7,781,660 B2
(45) Date of Patent: Aug. 24, 2010

(54) EXPANDABLE DRUM

(76) Inventor: James J. Paterson, 41 Warrender Avenue, Apt 515, Toronto, Ontario (CA) M9B 5Z7

( * ) Notice: Subject to any disclaimer, the term of this patent is extended or adjusted under 35 U.S.C. 154(b) by 0 days.

(21) Appl. No.: 12/457,232

(22) Filed: Jun. 4, 2009

(65) Prior Publication Data

US 2009/0308226 A1 Dec. 17, 2009

Related U.S. Application Data

(60) Provisional application No. 61/131,861, filed on Jun. 13, 2008.

(51) Int. Cl.
*G10D 13/02* (2006.01)

(52) U.S. Cl. ..... 84/412; 84/411 R; 84/421

(58) Field of Classification Search ..... 84/411 R, 84/412, 421
See application file for complete search history.

(56) References Cited

U.S. PATENT DOCUMENTS 578,198 A * 3/1897 Boulanger ..... 84/411 R
663,854 A * 12/1900 Boulanger ..... 84/411 R
673,633 A 5/1901 Boulanger
1,420,233 A * 6/1922 Baldwin et al. ..... 84/411 R
1,456,242 A 5/1923 Leedy
1,767,133 A * 6/1930 Hunt ..... 84/415
1,768,438 A 6/1930 Clark
2,462,603 A * 2/1949 Boots ..... 411/304
2,563,346 A 8/1951 Livingston
3,215,021 A 11/1965 Kester
3,911,779 A * 10/1975 Della-Porta ..... 84/411 R
3,981,220 A 9/1976 Clark
4,060,019 A * 11/1977 Cordes ..... 84/411 R
4,300,437 A * 11/1981 Hinger et al. ..... 84/411 R
5,377,576 A * 1/1995 Good et al. ..... 84/411 R
5,410,938 A * 5/1995 Kurosaki et al. ..... 84/411 R
6,242,679 B1 * 6/2001 Carlson ..... 84/411 R
6,462,262 B2 * 10/2002 Hagiwara ..... 84/411 R
7,084,338 B2 8/2006 Hagiwara
7,495,160 B2 * 2/2009 Hoshino et al. ..... 84/411 R
2009/0013850 A1 1/2009 Abe
2009/0308225 A1 * 12/2009 Natali ..... 84/411 R
2009/0308226 A1 * 12/2009 Paterson ..... 84/412

FOREIGN PATENT DOCUMENTS

GB 333081 8/1930
JP 2001-318667 11/2001

* cited by examiner

*Primary Examiner*—Jeffrey Donels
*Assistant Examiner*—Robert W Horn

(57) ABSTRACT

An interchangeable drum assembly having a first drum body member, a first drum skin, a first drum skin tension device secured to said first drum body member, a second drum body member, a second drum skin, first tension members on the first drum body, second tension members on the second drum body, and, drum body connector rods extending between the first and second drum bodies by which the first and second drum bodies are attached to one another in edge abutting relation, and a drum body extension which can be releasably positioned between the first and second drum body members, to make the drum body deeper.

14 Claims, 6 Drawing Sheets

EXPANDABLE DRUM

FIELD OF THE INVENTION

This application claims priority of the filing date of U.S. Provisional application Ser. No. 61/131,861 filed Jun. 13 2008, Title EXPANDRUM SYSTEM.

The invention relates to drums, and in particular to a drum apparatus in which the drum body can be interchanged and made longer or shorter to change the size of the drum.

BACKGROUND OF THE INVENTION

Drums conventionally employ a cylindrical drum body defining a hollow chamber, and a drum skin, on one, or both ends of the body. The drum skins are mounted in hoops which supports the skins. Tensioning devices are attached to the exterior of the body, and to the hoops. By adjusting the tensioning devices, the drum skins can be made tighter or looser.

Usually there are drum skins and hoops and tensioning devices at both ends of the body.

All of this has been well known. Drums will have different sounds depending on the depth of the drum body. A drummer may require a drum with a body of one size for one type of performance and may require a drum with a body of a different size for another performance. This would require an investment in two or more drums of different sizes. The drummer will have the inconvenience of carrying several drums of different sizes, if they are required for an occasion.

Various proposals have been made to provide a drum with an extension for the body. The intent has been that the drummer can modify the drum by increasing or decreasing the depth of the drum body.

However, the proposals that have been made in the past have been somewhat cumbersome and complex. The construction of a drum requires tensioning devices, located at spaced points around the circumference of the drum skin(s), These devices must be attached to the drum body, so that the skin(s) can be tensioned equally around the drum body. Where there are both top and bottom drum skins, it may be desirable to tension one skin at a tension different from the other. For this reason separate top and bottom tension devices are provided.

These features are provided with conventional drums, by attaching the tensioning devices to the drum body. The tensioning devices connect to each drum skin ring by means of tension rods, in this type of drum. It is found that the tension rods should be kept out of contact with the drum body, since any contact may impair the sound of the drum.

Where it has been proposed in the past to attempt to provide a drum with a drum body which can be extended, these features have been a compromise. Clearly it would be necessary to attach and secure the various parts of the drum body together. However, the components for such attachment should be free of contact with the drum body as far as possible, for the reasons explained above.

BRIEF SUMMARY OF THE INVENTION

The invention therefor seeks to provide an interchangeable drum assembly comprising, a first drum body member, a first drum skin, first drum skin tension device secured to said first drum body member, a second drum body member, a second drum skin, a first tension members secured to said first drum body;

second tension members secured to said second drum body, and, drum body connector rods extending between some of said first and second tension members whereby said first drum body and said second drum body are attached to one another in edge abutting relation.

Preferably there will be first drum skin tension rods connecting with a first drum skin hoop, and second drum skin tension rods connecting with a second drum skin hoop.

Preferably the connector rods will be received in respective first tension members and second tension members.

Preferably the connecting rods will be releasable to permit the first drum body and second drum body to be separated from one another.

Preferably there will be a drum body extension which can be placed between the first drum body and the second drum body, and longer connector rods will extend between the first tension member and the second tension member holding the first drum body and second drum body and the drum body extension together.

Preferably the first tension member and the second tension member will have extension portions overlapping the drum body extension and holding it in alignment with the first drum body and the second drum body.

Preferably the first tension member and second tension member will be secured to their respective first drum body and second drum body by bolts passing from the interior of the first drum body and second drum body into the first tension member and second tension member.

Preferably the first tension member and the second tension member will comprise an inner box portion and an outer box portion interfitting with one another, with the bolts passing from the first drum body and second drum body through the inner box portion and secured in the outer box portion.

In an alternate embodiment, an extension kit for an existing drum can be provided in which a plurality of connector blocks are attachable to the tension members on respective drum body halves, and connector rods extend between the connector blocks.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

FIG. 7 is an exploded perspective of the tension member from another direction; and.

DESCRIPTION OF A SPECIFIC EMBODIMENT

Figure 1:
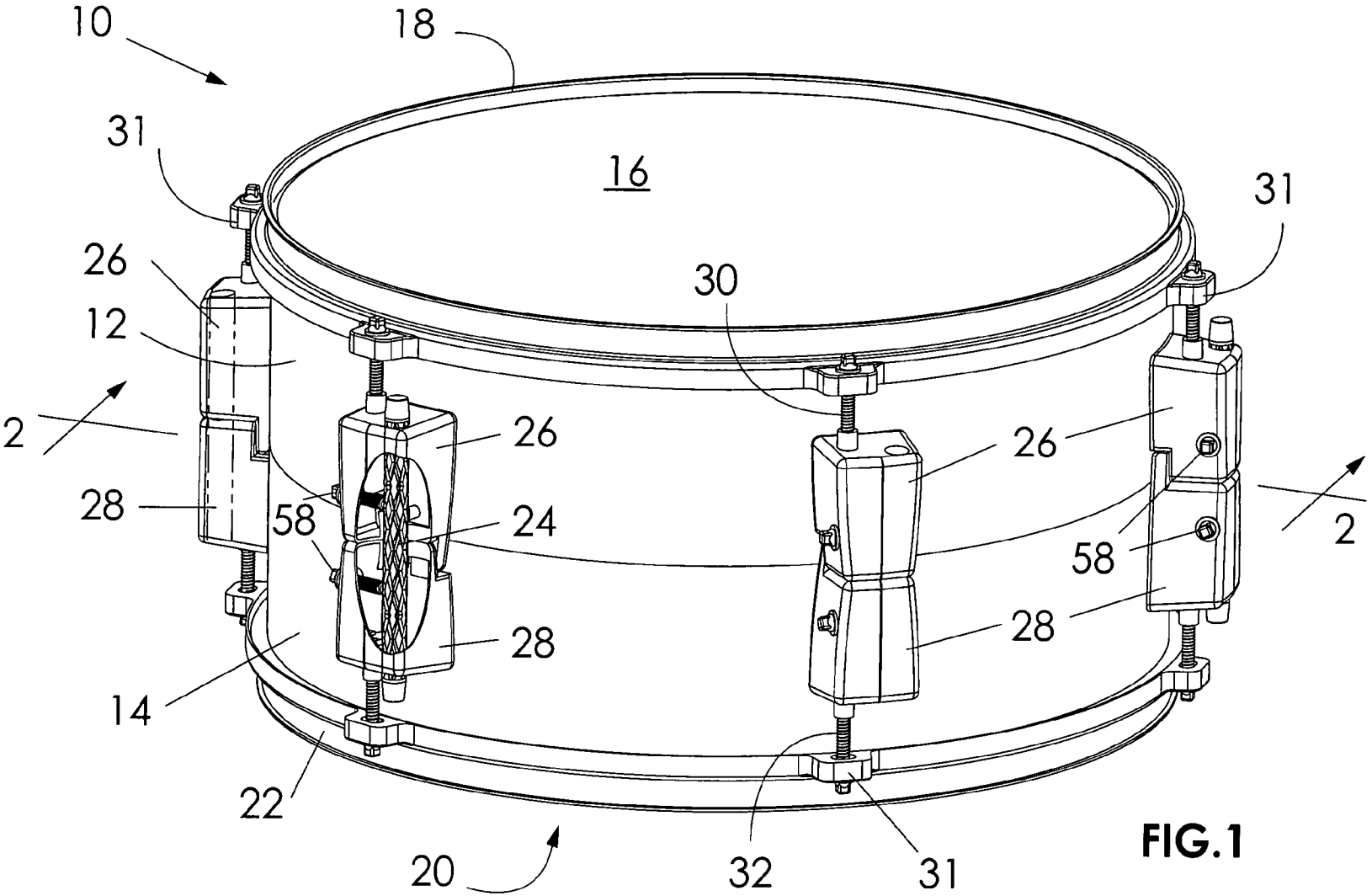
FIG. 1 is a perspective of a interchangeable drum illustrating the invention.
Figure 2:
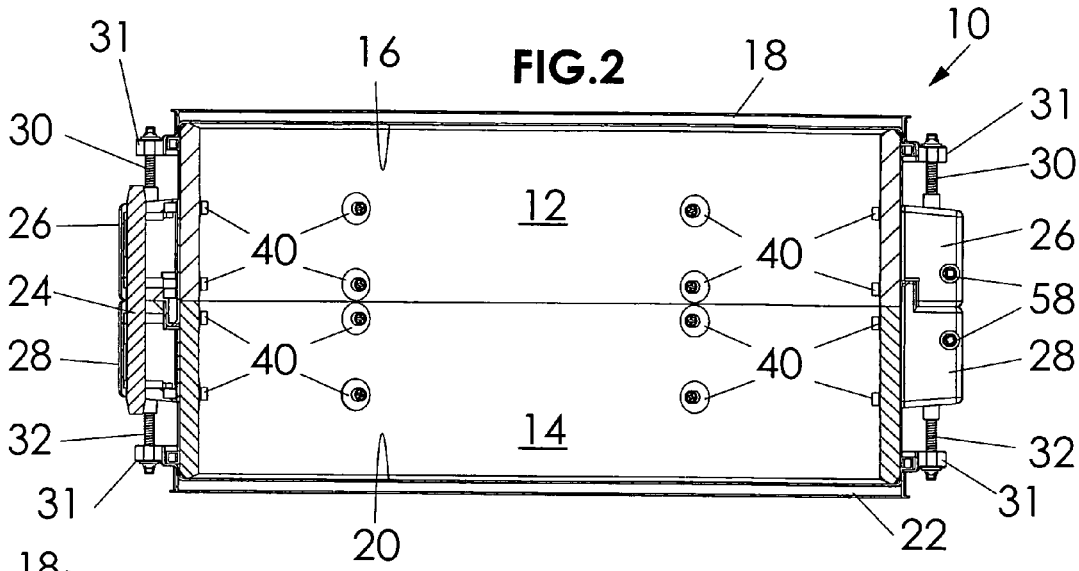
FIG. 2 is a section along line 2-2 of FIG. 1.

As shown in FIGS. 1 and 2 the invention is illustrated here in the form of a drum (10) The drum (10) has a first drum body member (12) and an second drum body member (14), each of cylindrical construction and of identical diameter and wall thickness, and in this case of the same material, though other materials may be used if desired. The two drum bodies abut each other at their adjoining edges to form a single body for drum (10). First drum body member (12) has a first drum skin (16) and a first drum skin hoop (18). Second drum body member (14) has a second drum skin (20) and a second drum skin hoop (22).

The first drum body member and second drum body member are held together in a manner described below by drum body connecting rods (24)

The first drum body member (12) has first tension members (26) attached at spaced locations around its circumference by suitable bolts.

Second drum body member (14) has second tension members (28) attached at spaced locations around its circumference.

The first drum skin hoop (18) is connected to the first tension members (26) by first tension rods (30) and lugs (31).

The second drum skin hoop (22) is connected to the second tension members (28) by second tension rods (32) and lugs (31).

In this way the respective first drum skin (16) and second drum skin (20) can be tensioned over the ends of the respective first drum body member (12) and second drum body member (14), but are independent of each other.

Figure 6:
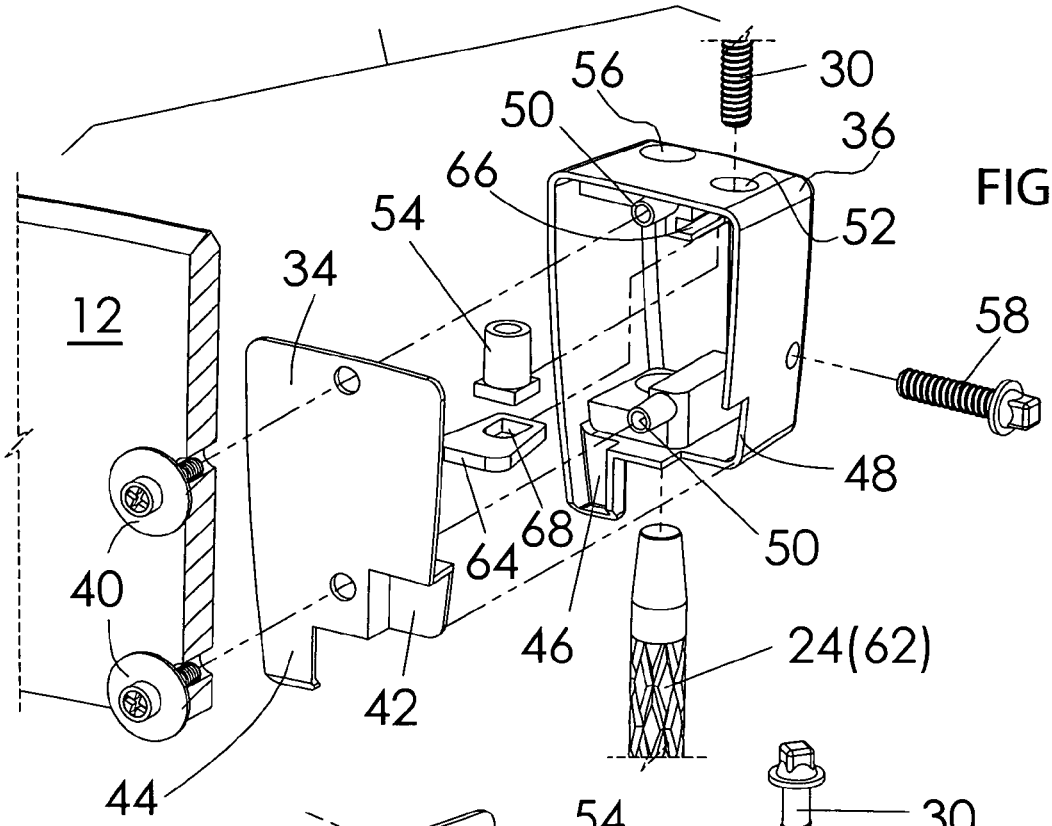
FIG. 6 is an exploded perspective of a tension member from one direction.
Figure 7:
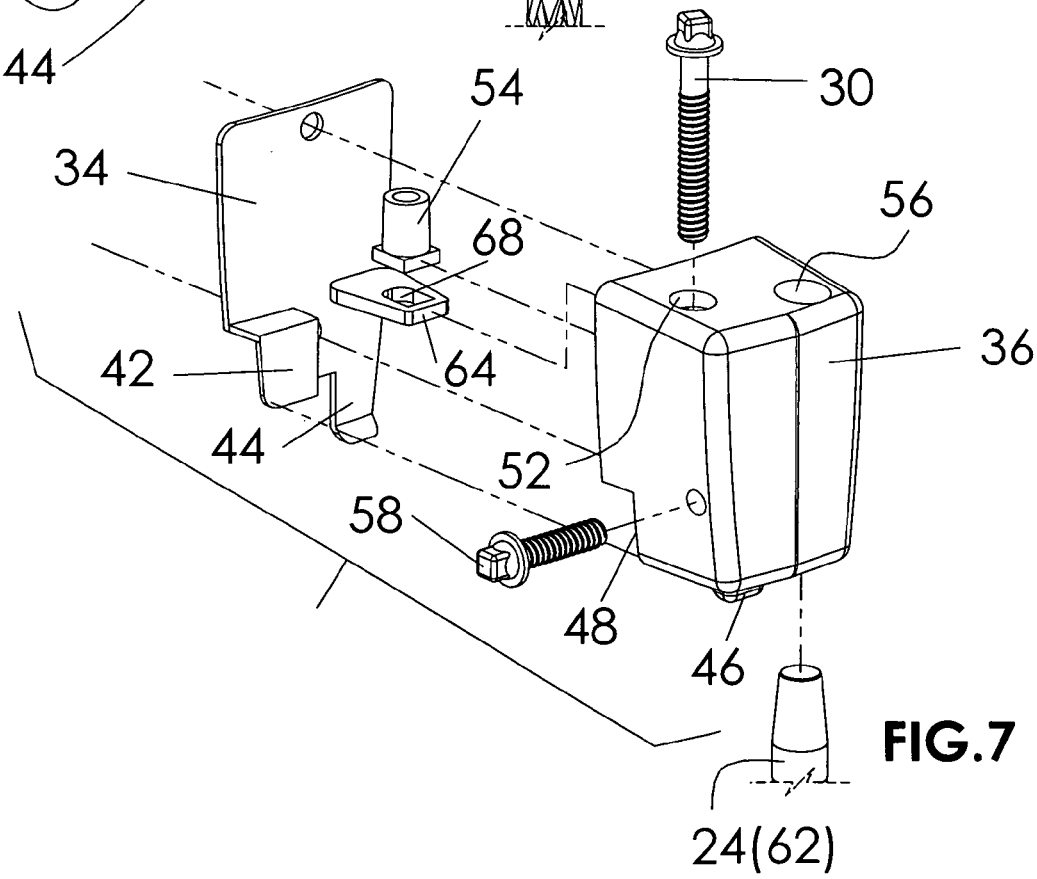

The first tension member (26) and the second tension member (28) are formed as shown in FIGS. 6 and 7.

They each comprise a hollow box-like enclosure or chamber formed by an inner gasket portion (34) and an outer box portion (36), which are formed with complementary shapes to interfit together and form a hollow box or chamber.

The inner gasket portion (34) has bolt holes (38) for passage of bolts (40) from the interiors of the respective first drum body member and second drum body member.

The inner gasket portion (34) has an inwardly angled indent (42), on one side, and has an extension lip (44) on the other side, for reasons to be described below.

The outer box portion (36) has an elongated shell (46), extending therefrom in registration with the extension lip (44) of the inner gasket portion (34), for reasons to be described below.

The outer box portion (36) has a cut away wall (48), complementary to the inward angled indent (42) of the inner gasket portion (34) for reasons to be described below.

The outer box portion (36) has threaded recesses (50) for receiving bolts (40) and thus securing the inner gasket portion and the outer box portion to the exterior of the first drum body member, or second drum body member, respectively.

The outer box portions (36) have tension rod openings (52) for receiving the respective first tension rod (30) and second tension rod (32). Socket nuts (54) are located inside outer box portion (36) for receiving the first tension rod or second tension rod respectively.

The outer box portion has two connector rod openings (56) for receiving the drum body connector rods(24). Transverse bolts or set screws (58) can be torqued onto drum body connector rods(24) to hold the first drum body member and second drum body member secured together.

The drum body connector rods(24) in this case may have any suitable frictional surface formations such as knurling. Alternatively the rods may be threaded, and nuts could be used on threaded rods to hold the drum bodies assembled. In this case the set screws could be dispensed with.

Figure 3:
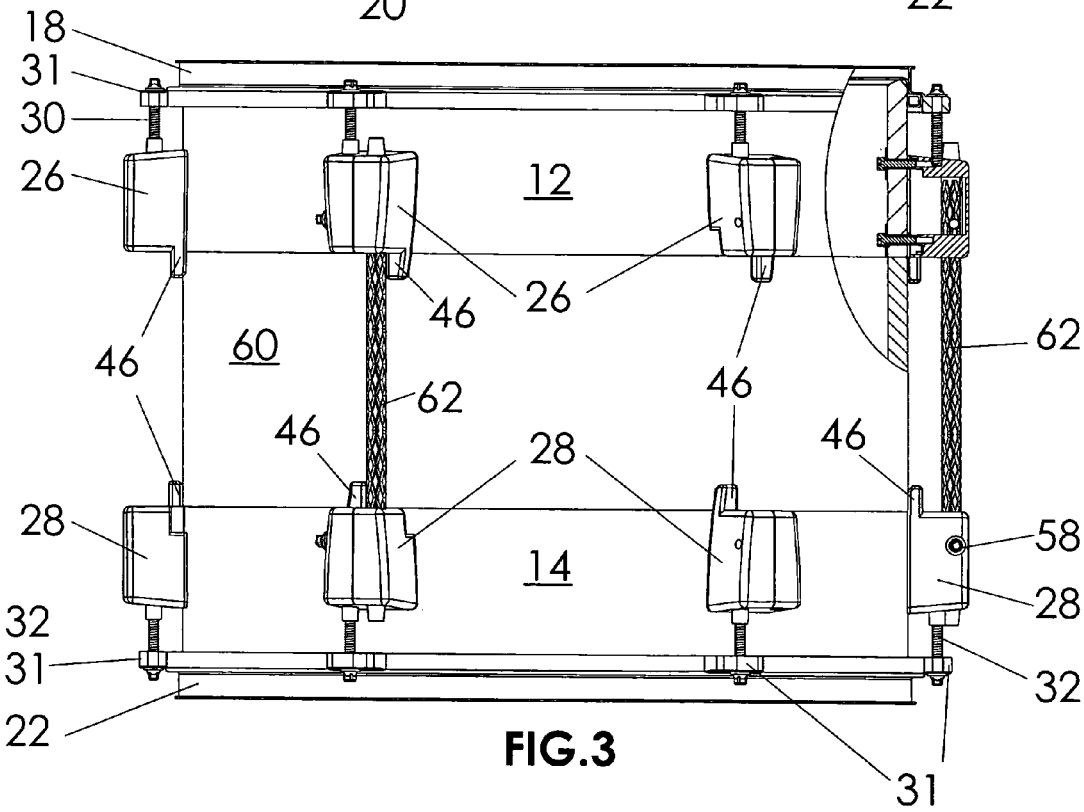
FIG. 3 is a side elevation of the drum of FIGS. 1 and 2 showing an extension portion in position.
Figure 4:
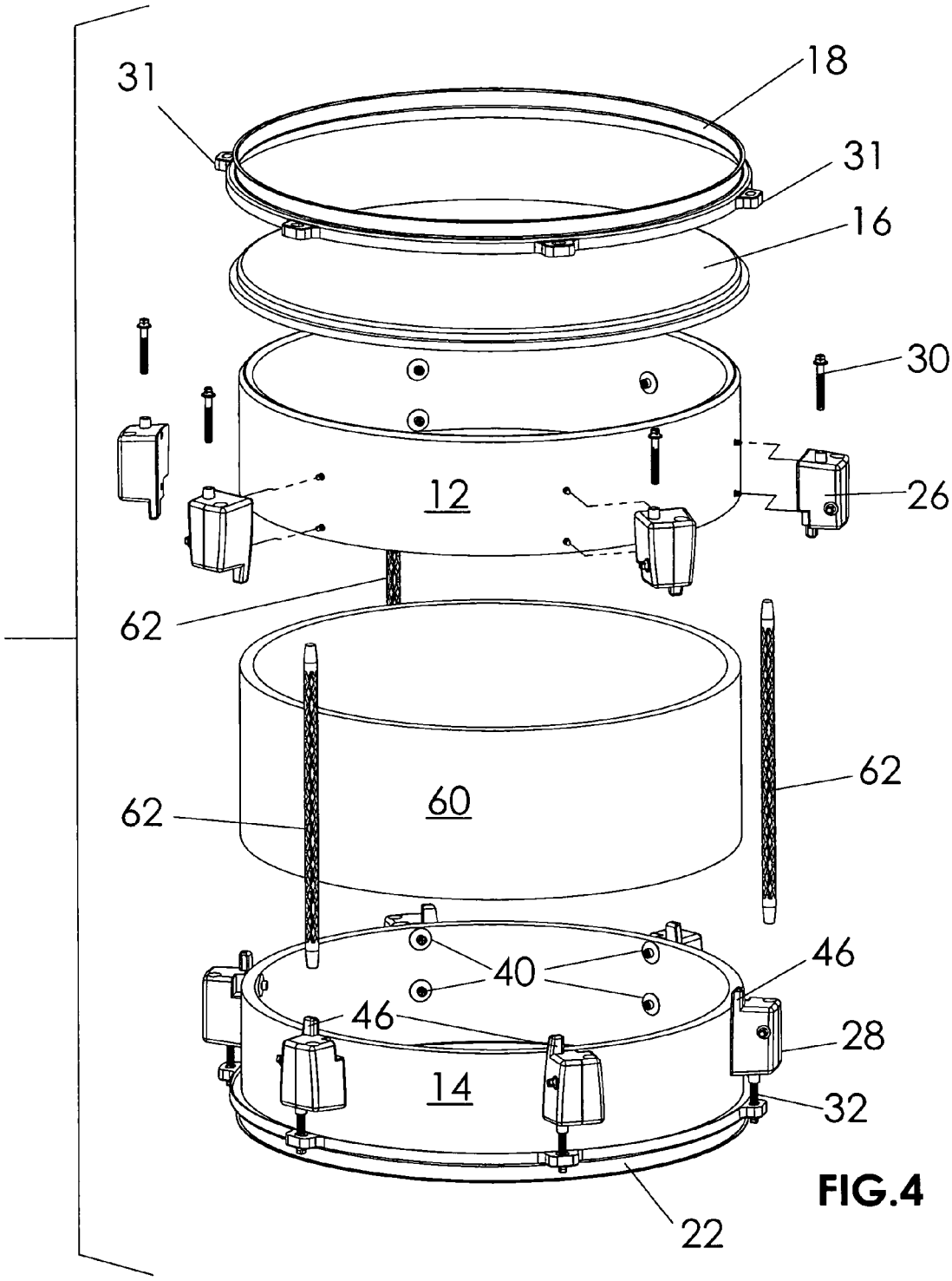
FIG. 4 is an exploded perspective of FIG. 3 and showing an extension portion, and connecting rods.
Figure 5:
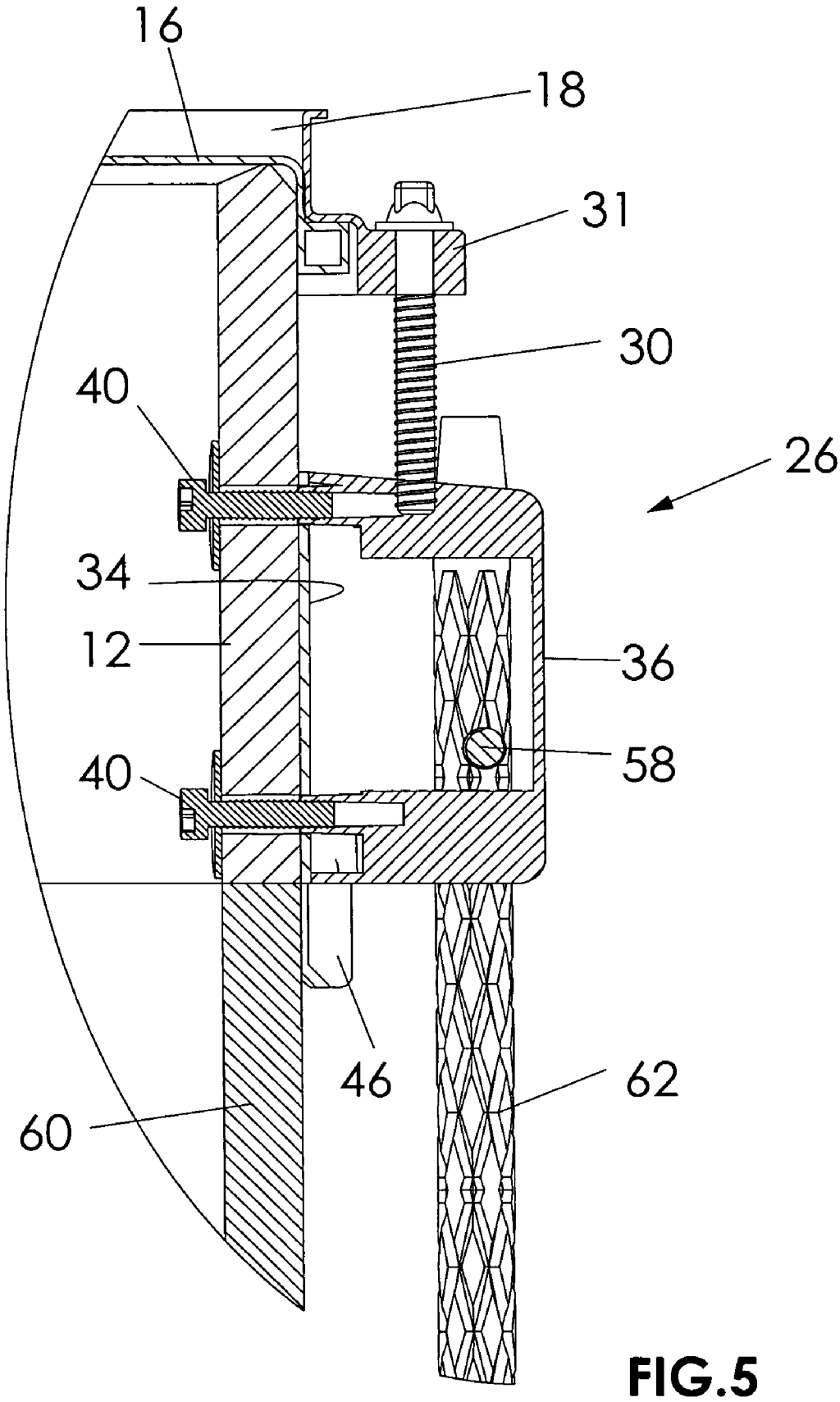
FIG. 5 is an enlarged side elevation of a detail of FIG. 3.

In order to provide a drum having a deeper drum body, one (or more) drum body extensions (60) are provided FIG. 3 and 4. The drum body extension (60) is a cylindrical tubular member, in this case being of the same material as the first drum body member and second drum body member although other materials may be used if desired, and usually having the same wall thickness.

The drum body extension (60) is simply placed between the edges of the first drum body member and the second drum body member, in edge abutting relation.

Longer drum body connector rods(62) are then fitted into the appropriate first tension 20 member and second tension member, and bolts or set screws (58)are torqued firmly to hold the edges of the first drum body member, second drum body member and drum body extension together.

It will be seen that the shell (46) of each of the first tension member and second tension member overlap the adjacent edge of the drum body extension (60).

The shell (46) also overlap the edges of the first and second drum bodies, when in the shorter drum mode of FIG. 1. In this way the drum body extension (60) is held in alignment with the first drum body member and second drum body member.

When the drum body extension is not in use, and the drum (10) is back down to the smaller size as in FIG. 1, the elongated shell (46) of one tension member will be received in the inward angled indent (42) and cut away wall (48), so that they interdigitate with one another.

A resilient holding plate (64) is supported in slides (66) within the outer box portion (36), having a hole (68) registering with the first tension member or second tension member as the case may be. Plate (64) may be of rubber, or similar synthetic material and functions to hold the socket nuts (54) in position in registration with the tension rod openings (52).

The utility of the invention will be self explanatory from the above.

By the mere addition of the elongated shell (60) and the longer drum body connector rods (62) the drum (10) of FIG. 1 can be changed into the deeper drum of FIG. 3. It can be changed back again in the manner described.

An alternate embodiment can provide a form of extension kit for changing the size of an existing drum. The owner of a drum may wish to extend its depth (or may wish to reduce it). The kit will permit this, given a certain degree of handyman skills on the part of the drum owner.

Figure 8:
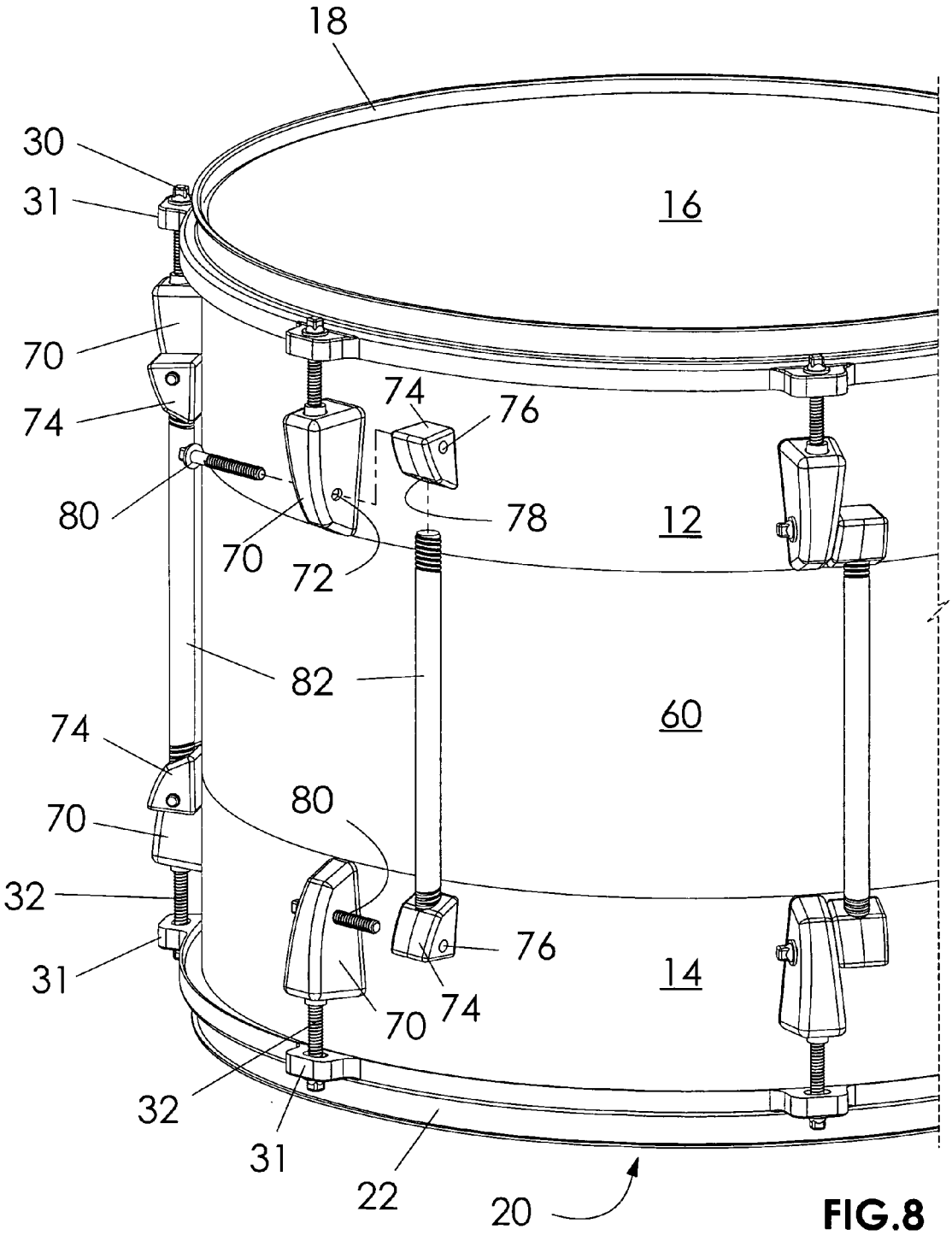
FIG. 8 is a perspective of an alternate embodiment, providing an extension kit for changing the size of an existing drum.

FIG. 8 shows a preexisting drum having upper and lower drum bodies (12) and (14). These drum bodies may have been originally in one piece as a single integral drum body. The owner has simply cut them in to two parts, with a saw. For that reason the two bodies are referenced as (12) and (14). Each of the drum bodies has a skin (16) and (18) and a hoop (20) and (22).

Each of the drum bodies has tension members (70). Such tension members are generally available for construction of conventional drums.

In order to adapt them for use with the extension kit, the tension members are drilled out, transversely as at (72), by the owner.

Connector blocks (74) are provided, which can be attached to respective drum bodies.

Transverse holes (72), which may be internally threaded, receive bolts (80) from tension members (70), for attaching the connector blocks to respective drum bodies. Alternatively the blocks could be attached to the drum bodies by bolts (not shown) as in FIG. 6 for example.

Threaded recesses (78) in blocks (74) receive connector rods (82). An extension body (60) can be placed between bodies (12) and (14). The connector rods (82) can be torqued down to grip the body (60) in position.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An interchangeable drum assembly comprising;

a first drum body member, having a first drum skin and hoop;

a second drum body member, having second drum skin and hoop;

first tension members on the first drum body for tensioning said first drum skin, each said first tension members comprising a first outer box portion defining a hollow interior chamber;

first tension rods connecting from said first drum skin and entering respective said first tension members;

holes in said first outer box portions for reception of drum body connector rods in said chambers;

bolts passing from the first drum body and extending into and secured in the first outer box portion;

second tension members on the second drum body for tensioning said second drum skin, said second tension member comprising a second outer box portion defining a hollow interior chamber;

second tension rods connecting from said second drum skin and entering respective said second tension members;

holes in said second outer box portions for reception of drum body connector rods in said chambers;

bolts passing from the second drum body and extending into and secured in the second outer box portions; and, drum body connector rods extending between said first and second drum bodies and passing through said holes in said outer box portions into the interior of respective said hollow chambers of said first and second tension members, and connected to said some of first and second tension members whereby the first and second drum bodies are attached to one another in edge abutting relation.

2. An interchangeable drum assembly as claimed in claim 1 including first and second drum skin hoops, and said first tension rods connecting with said first drum skin hoop, and said second tension rods connecting with said second drum skin hoop.

3. An interchangeable drum assembly as claimed in claim 2 including tension rod openings in respective said first and second tension members and wherein said tension rods pass into respective tension members through said openings and wherein said drum body connector rods pass into some of said first and second tension members.

4. An interchangeable drum assembly as claimed in claim 3 wherein said drum body connector rods are releasable from said tension members to permit the first drum body and second drum body to be separated from one another.

5. An interchangeable drum assembly as claimed in claim 4 including a drum body extension between the first drum body and the second drum body, and extension drum body connector rods extending between the first tension member and the second tension member holding the first drum body and second drum body and the drum body extension together.

6. An interchangeable drum assembly as claimed in claim 5 including first extension portions extending from said first tension members overlapping the drum body extension and second extension portions extending from said second tension members overlapping and holding said drum body extension in alignment with the first drum body and the second drum body.

7. An interchangeable drum assembly as claimed in claim 6 wherein the first tension member and the second tension member include an inner gasket portion interfitting with respective first and second outer box portions with the bolts passing from the first drum body and second drum body through the inner gasket portion and secured in the outer box portion.

8. An interchangeable drum assembly as claimed in claim 5 wherein said connector rods pass into respective hollow chambers of said first and second tension members and including set screws in said first and second tension members operable to engage and hold respective said connector rods.

9. An interchangeable drum assembly as claimed in claim 8 including socket nuts in said hollow chambers of said first and second tension members registering with said holes therein, for reception of respective first and second tension rods within said hollow interior chambers thereof.

10. An interchangeable drum assembly as claimed in claim 9 including first resilient members in of said first tension members and second resilient members in said second tension members, each said resilient member inter engaging with a respective one of said socket nuts and holding it in registration with its respective hole.

11. An interchangeable drum assembly comprising;

a first drum body member, having a first drum skin and hoop;

a second drum body member, having second drum skin and hoop;

first tension members on the first drum body for tensioning said first drum skin;

second tension members on the second drum body for tensioning said second drum skin;

a plurality of connector blocks attachable to respective tension members on respective drum bodies;

connector rods connectable between pairs of said connector blocks; and, drum body connector rods extending between said first and second drum bodies and connected to said some of said connector blocks whereby the first and second drum bodies are attached to one another in edge abutting relation.

12. A tension member for use in association with other said tension members for use in the assembly of first and second drum bodies, to hold said first and second drum bodies together and comprising:

a first tension member attachable to a said first drum body;

a second tension member attachable to a said second drum body;

each said tension member comprising an outer box portion defining a hollow interior;

first extension portions on said first tension members and extending from said first tension members for overlapping said second drum body, for holding the two drum bodies in alignment;

second extension portions on said second tension members and extending from said second tension members for overlapping said first drum body, for holding the two drum bodies in alignment; and, drum body connector holes in said outer box portions for receiving connector rods for extending between said first and second tension members whereby the first and second drum bodies are attached to one another in edge abutting relation.

13. An interchangeable drum assembly as claimed in claim 12 including bolts connectable between said tension members and said connector blocks for attaching said connector blocks to said tension members.

14. An interchangeable drum assembly as claimed in claim 13 including transverse holes extending into said connector blocks for receiving said bolts, and holes normal to said transverse holes for receiving said connector rods.

* * * * *